US005418545A

United States Patent [19]

Pantsios et al.

[11] Patent Number: 5,418,545

[45] Date of Patent: May 23, 1995

[54] VARIABLE LENGTH SLOT FED DIPOLE ANTENNA

[75] Inventors: Fred A. Pantsios, Sacramento, Calif.; Theodore S. Hebron; William A. Kerkhoff, both of Quincy, Ill.

[73] Assignee: Harris Corporation, Melbourne, Fla.

[21] Appl. No.: 151,341

[22] Filed: Nov. 9, 1993

[51] Int. Cl.[6] ..... H01Q 9/28

[52] U.S. Cl. ..... 343/795; 343/767; 343/789; 343/797; 343/798; 343/806; 343/808; 343/834

[58] Field of Search ..... 343/767, 795, 797, 834, 343/789, 808, 798, 806; H01Q 9/28

[56] References Cited

U.S. PATENT DOCUMENTS

| | | | |
|---|---|---|---|
| 2,145,024 | 1/1939 | Bruce | 343/834 |
| 2,480,154 | 8/1949 | Masters | 343/795 |
| 2,803,011 | 8/1957 | Bouchard | 343/834 |
| 5,274,391 | 12/1993 | Connolly | 343/789 |

OTHER PUBLICATIONS

IEEE Antennas and Propogation Society Newsletter entitled "Research on Transmitting Antennas", dated Jun., 1989, pp. 6–22.

*Primary Examiner*—Donald Hajec
*Assistant Examiner*—Steven P. Wigmore
*Attorney, Agent, or Firm*—Tarolli, Sundheim & Covell

[57] ABSTRACT

A slot fed antenna is disclosed for use in radiating energy. The antenna includes a flat conductive member having an elongated vertically-oriented slot dividing the member into a pair of horizontally-extending variable-length flat dipole wing elements. Each of the flat dipole wing elements has a vertically-extending rectilinear edge. Also, each wing element extends in width in a direction perpendicular to the rectilinear edge from a minimum at its center and at each of its upper and lower ends to a maximum midway between each of the ends and the center.

12 Claims, 4 Drawing Sheets

VARIABLE LENGTH SLOT FED DIPOLE ANTENNA

FIELD OF THE INVENTION

This invention relates to the art of antennas and, more particularly, to improvements relating to variable length slot fed dipole antennas.

DESCRIPTION OF THE PRIOR ART

Antennas constructed in a somewhat similar manner in the prior art are known and are frequently referred to as bat wing or delta wing antennas. Such antennas include a pair of flat conductive members which are mounted to a mast with the conductive members of each pair extending outwardly in a vertical plane. The conductive members are sometimes referred to as wings. Such an antenna, for example, is illustrated in the R. W. Masters U.S. Pat. No. 2,480,154. Each wing includes a vertically-extending rectilinear edge extending parallel to the vertical mast. Each wing extends away from the rectilinear edge so that the width of the wing in a direction perpendicular to the edge varies in width along the entire length so that it has a width at the center of the wing of approximately one-eighth wavelength and is approximately one-quarter wavelength at its upper and lower ends. The antennas disclosed in the Masters patent are excited by a coaxial cable connected to the antenna wings. A similar configuration to that of the antenna disclosed in the Masters patent noted above has been considered taking the form of a vertically-oriented slot dividing the member into a pair of slot fed horizontally-extending dipole wing elements with each wing element corresponding with that as shown in the Masters patent and in FIG. 1 herein to be described hereinafter.

The present invention is directed toward improvements over the prior art as noted above to achieve improvements in impedance bandwidth and in pattern bandwidth. As used herein, the term impedance bandwidth refers to the percentage of frequency for which the impedance performance does not exceed a predetermined VSWR specification. Also, the term pattern bandwidth, as used herein, refers to the percentage of frequency for which the half power beamwidth performance does not vary beyond a predetermined maximum and minimum.

SUMMARY OF THE INVENTION

It is therefore a primary object of the present invention to provide an antenna having improved impedance bandwidth and pattern bandwidth compared to the prior art as discussed above.

In accordance with one aspect of the present invention, a slot fed antenna is provided for use in radiating energy. This antenna includes a flat conductive member having an elongated vertically-oriented slot dividing the member into a pair of slot fed horizontally-extending variable length flat dipole wing elements. Each of the flat dipole wing elements has a vertically-extending rectilinear edge. Each wing element varies in width in a direction perpendicular to the rectilinear edge from a minimum at its center and at each of its vertically-spaced ends to a maximum midway between each of the vertically-spaced ends and the center.

BRIEF DESCRIPTION OF THE DRAWINGS

The foregoing and other objects and advantages of the invention will become more readily apparent from the following description of a preferred embodiment, as taken in conjunction with the accompanying drawings, which are a part hereof, and wherein.

DESCRIPTION OF PREFERRED EMBODIMENTS

Figure 1:
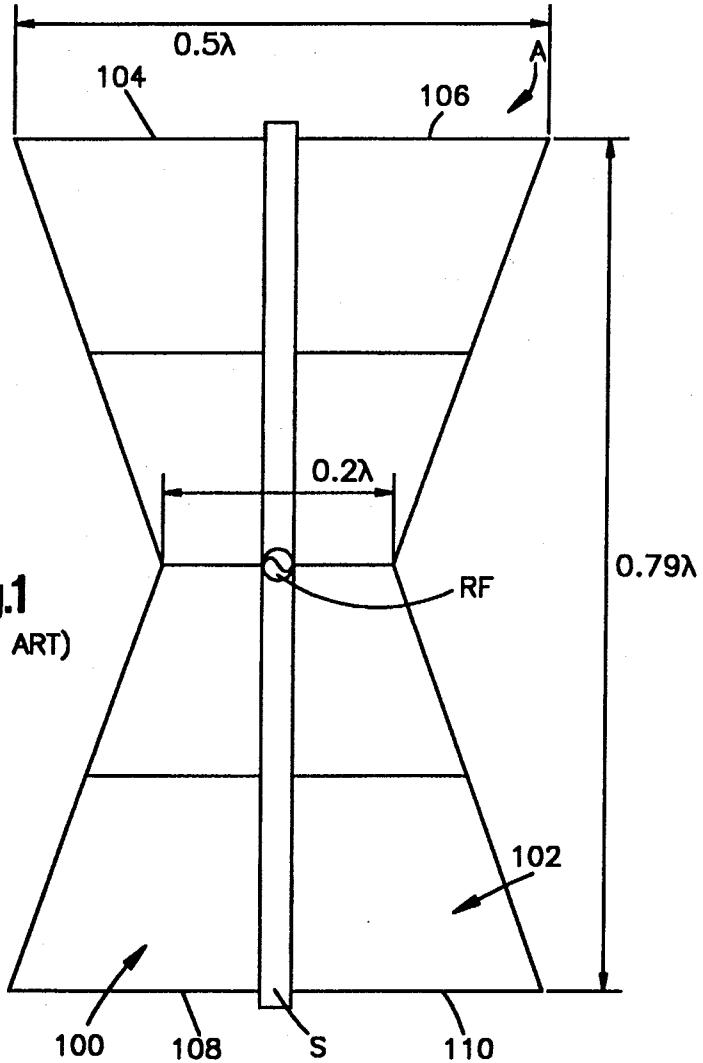
Fig.1 (PRIOR ART)
FIG. 1 is an elevational view illustrating a prior art antenna to be discussed herein.

Before describing the embodiments of the invention in accordance with FIGS. 2–9, reference is first made to FIG. 1 which illustrates a prior art antenna based on that disclosed in the R. W. Masters U.S. Pat. No. 2,480,154 with the exception that the antenna A disclosed in FIG. 1 is a slot fed antenna having an RF source connected across the slot at a location midway between the ends of the slot as opposed to connecting the wings with coaxial cables as described in the Masters patent. The antenna A in FIG. 1, as in the case of the embodiment of the invention of FIG. 2, may be constructed from a solid metal sheet or a mesh wire sheet or wire rods or strip line elements. In the embodiments illustrated in FIGS. 1 and 2, the antennas are shown as employing wire rods. In the prior art antenna A in FIG. 1, a slot S divides the antenna into a pair of wings 100 and 102. As noted, each wing is constructed of a plurality of wire rods. Each wing acts as a radiator of electromagnetic energy. The wings 100 and 102 are formed by V-shaped notches or cut-out portions extending in width along the entire length of the wing elements. These V-shaped notches or cut-out portions have resulted in wing structures that have been referred to as either bat wings or delta wings. The wings 100 and 102 vary in width from a minimum width at a location midway between the ends of slot S (i.e., at the center of the slot) and increase continuously in width in a direction toward the upper end of the antenna and in a direction toward the lower end of the antenna. The maximum width of the wings 100 and 102 is found at the upper end of the antenna and at the lower end of the antenna, as is seen in FIG. 1. The maximum width may be on the order of 0.5 wavelength whereas the minimum width is on the order of 0.2 wavelength. One structure that has been employed in accordance with the configuration as shown in FIG. 1 employed a spacing on the order of 0.79 wavelength between the upper and lower ends (or edges) of the wings.

It has been determined that with the RF energy applied to the slot fed antenna as shown in FIG. 1, the E field has a parabolic distribution along the length of the slot so that it is at its minimum near the lower and upper edges of the slot and is at its maximum at the center of the slot. Consequently, the wire rods 104–106 at the top end of the antenna and the wire rods 108–110 at the bottom end of the antenna are located at points of the minimum E field distribution. Each of these pairs of wire rods 104–106 and 108–110 are one-half wavelength dipoles and it has been determined that greater excitation in these dipoles would take place if they were moved closer to each other where the distribution of the E field is greater. This has been achieved in accordance with the present invention with the antenna configuration in FIG. 2 wherein the corresponding half wavelength dipole wire rods 104'–106' and 108'–110' have been moved closer to each other so that they are now spaced apart by a distance on the order of 0.4 wavelength. It is to be noted that the elements in FIG. 2 that correspond with those in FIG. 1 have been identified with similar character references with those in FIG. 2 being designated with a prime (') such as wire rod 104' in FIG. 2 compared to wire rod 104 in FIG. 1.

Figure 2:
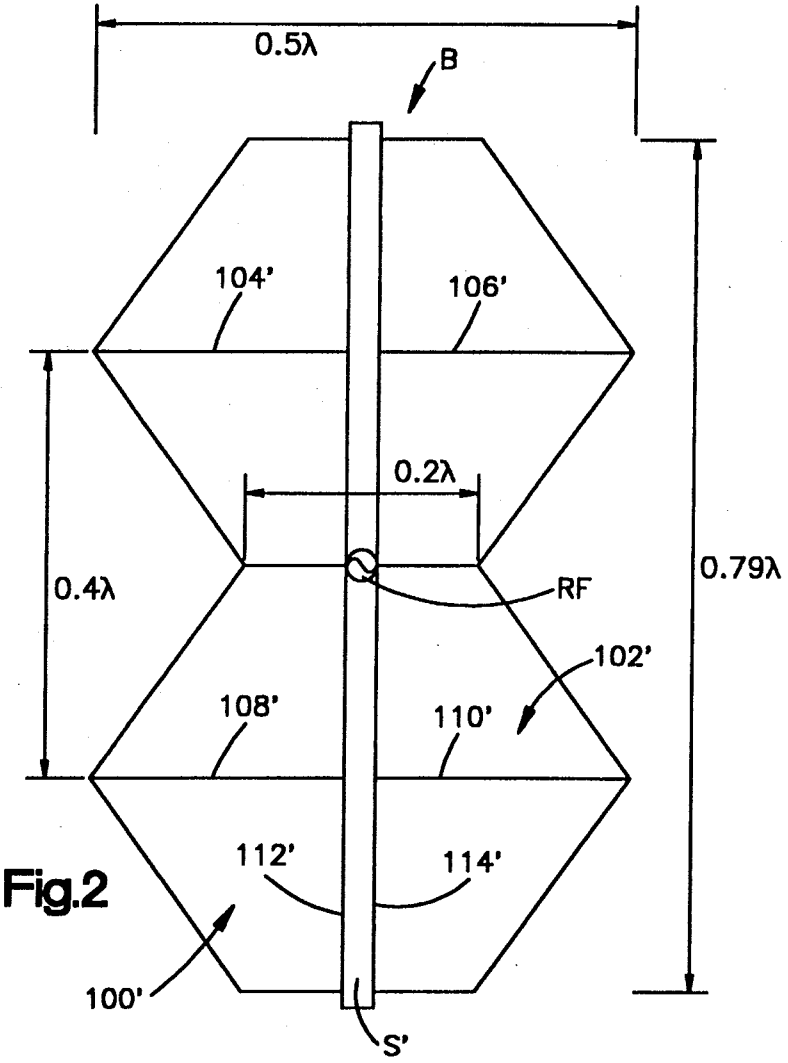
FIG. 2 is an elevational view similar to that of FIG. 1, but illustrating one embodiment of the antenna in accordance with the present invention.

The configuration of the antenna B shown in FIG. 2 may be considered as a W wing antenna as opposed to the delta wing antenna of FIG. 1. Thus, a broad W-shaped notch or cut-out portion extends along the entire length of each wing of the antenna. In this configuration, the half wavelength dipole rods 104'–106' and rods 108'–110' are located closer to the center of the slot whereby each is located at a point where the E field is greater than that of the half wavelength rods 104–106 and 108–110 in the antenna in FIG. 1. This results in improved impedance bandwidth and in improved pattern bandwidth as compared with the structures in FIG. 1.

The antenna B illustrated in FIG. 2 is a slot fed antenna and employs a flat conductive member which has an elongated vertical slot S' that divides the conductive member into a pair of slot fed horizontally-extending variable length flat dipole wings 100' and 102'. These wings 100' and 102' differ considerably from wings 100 and 102 in FIG. 1 for reasons as discussed herein. Wings 100' and 102' have vertically-extending rectilinear edges 112' and 114', respectively, which define the vertical side edges of slot S'. Each wing 100' and 102' extends in width in a direction perpendicular from its respective edge 112' or 114' so that the width varies from a minimum at the center and at each of its upper and lower ends to a maximum midway between each of the upper and lower ends and the center, as is seen in FIG. 2. Thus, the maximum width of the antenna is 0.5 wavelength and is located at the position of the half-wave wire rods 104'–106' and 108'–110', and these rods are located approximately 0.4 wavelength apart. The minimum width, at the center and at the upper and lower ends, is 0.2 wavelength. The configuration of FIG. 2 has resulted in improved impedance bandwidth and in improved pattern bandwidth over that of the antenna A in FIG. 1. As used herein, the term impedance bandwidth refers to the percentage of frequency for which the impedance performance does not exceed a predetermined VSWR specification. Also the term pattern bandwidth as used herein refers to the percentage of frequency for which the half power beamwidth performance does not vary beyond a predetermined maximum and minimum.

The pattern bandwidth of the W-wing antenna A of FIG. 2, as compared with the delta wing antenna B of FIG. 1, shows that the W-wing antenna B has a one-half power beamwidth variation which is smaller than that for a delta wing as the frequency is varied over a range from 470 MHz to 665 MHz, to 881 MHz and then to 860 MHz in the elevational plane.

During experimentation, measurements were taken that shows that the W-wing antenna B of FIG. 2 has a better impedance bandwidth performance than that of the delta wing antenna A of FIG. 1. Using a reference level of 1.12 VSWR, it has been determined that the W-wing antenna will have a VSWR of 1.12 or less over a frequency range of from approximately 470 MHz to 828 MHz. Using the same criteria, the delta wing antenna A has been found to have a VSWR equal to or less than 1.12 over a much narrower range from approximately 450 MHz to 600 MHz.

The improvements in the impedance bandwidth and the pattern bandwidth of the W-wing antenna B in FIG. 2 over that for the delta wing antenna A of FIG. 1 have been found to be the result of the change in the shape or configuration as described hereinabove with reference to FIG. 2. The antenna of FIG. 2 may be employed in a manner as shown in FIG. 2 and in other applications, such as those to be described hereinafter with reference to FIGS. 3–9.

Figure 3:
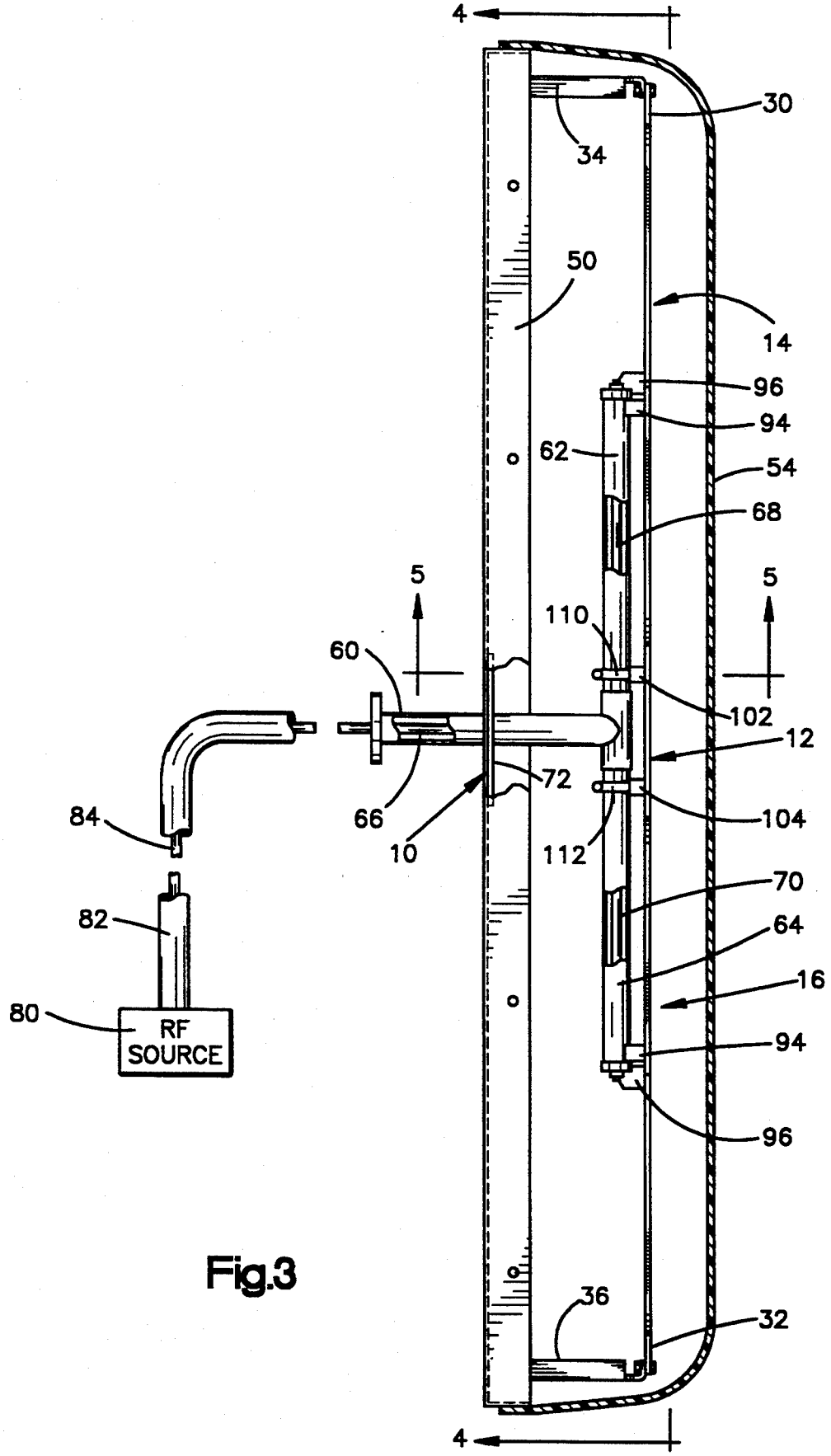
FIG. 3 is a side elevational view with parts broken away illustrating one application of the antenna in accordance with the present invention.
Figure 4:
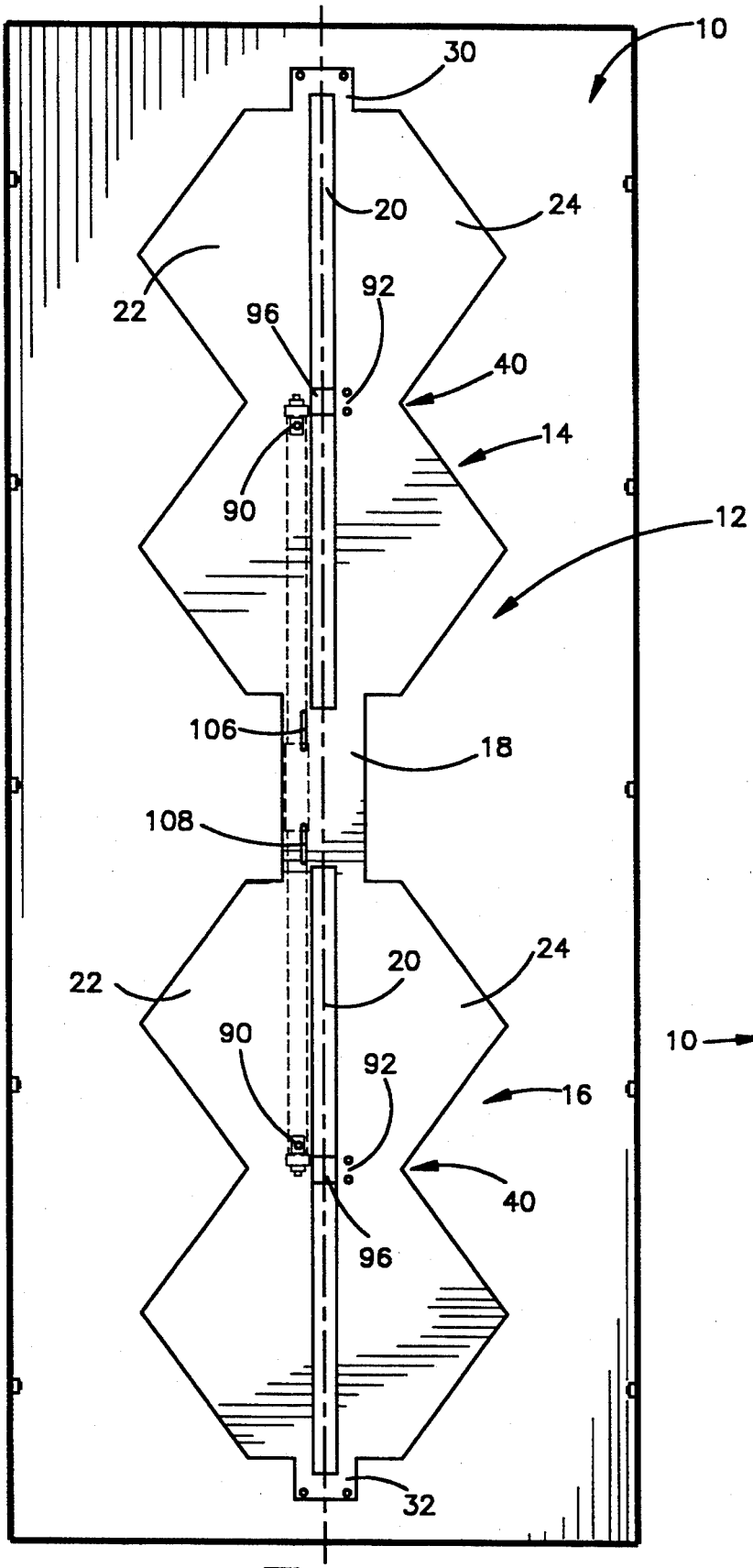
FIG. 4 is a view taken generally along line 4—4 looking in the direction of the arrows in FIG. 3 with the radome removed.
Figure 5:
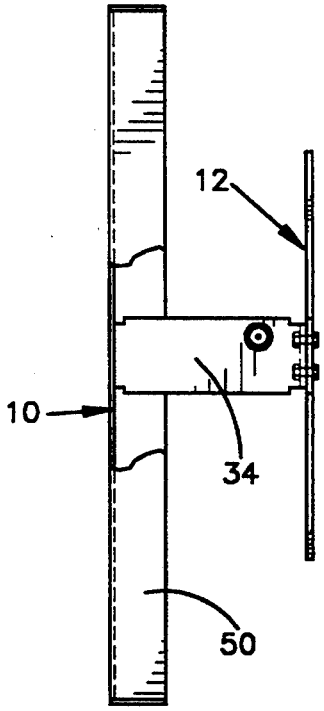
FIG. 5 is a view taken along line 5—5 looking in the direction of the arrows in FIG. 3 with the radome removed.

Reference is now made to FIGS. 3, 4, and 5 wherein there is illustrated an antenna system employing the antenna B of FIG. 2 for radiating horizontal polarized energy. This includes an elongated rectangular-shaped flat reflector or backscreen 10 constructed of a solid sheet of metal and which is shown in the drawings as being oriented in a vertical direction. A flat, elongated antenna panel 12 of solid sheet metal is vertically oriented and spaced in front of and parallel to the backscreen 10. The antenna panel 12 includes a pair of vertically-interconnected antennas 14 and 16, each corresponding with antenna B of FIG. 2, and which are interconnected by means of an intermediate member 18.

Each of the antennas 14 and 16 includes an elongated vertically oriented slot 20 which divides the antenna into a pair of horizontally extending variable length wings including a left wing 22 and a right wing 24. Each of these wings may be considered as a horizontally extending variable length dipole element. The slots 20 are of essentially the same length or slightly greater than the height of the corresponding antennas 14 and 16. At its upper end, antenna 14 is provided with a short extension 30, whereas the lower antenna 16 is provided with an extension 32 extending from its lower end. Extensions 30 and 32 are interconnected with the backscreen 10 by means of mounting brackets 34 and 36, respectively. These brackets are each secured at one end to the backscreen, as with nuts and bolts or with other suitable fastening means such as rivets, welding or soldering, and are each secured at the opposite end to extension 30 or 32, as with nuts and bolts, etc. The brackets 34 and 36 maintain a spacing between the backscreen and the antennas 14 and 16 on the order of one-quarter wavelength (λ) which distance, at the RF frequencies involved, operates as an open circuit. If the spacing between the backscreen 10 and the antenna panel 12 containing antennas 14 and 16 is decreased, there will be a corresponding increase in the operating frequency of the antenna.

As best seen in FIGS. 3 and 5, the peripheral side edges of the backscreen 10 have been bent so as to define a peripheral rim or lip 50 that extends perpendicularly from the backscreen in a forward direction toward the antenna 14. This peripheral lip 50 encircles the backscreen as well as the antenna panel 12. The lip 50 extends from the backscreen in the direction of the antenna panel a distance on the order of 0.1 wavelength (λ) at the operating frequency (F) of the antenna, thereby defining a single shallow cavity behind two interconnected flat dipole antennas 14 and 16. The shallow cavity assists in increasing the azimuthal gain in that it makes the beamwidth somewhat narrower in the horizontal plane. The backscreen reflector forces the radiated energy to go in a forward direction, away from the antenna, as well as to be somewhat narrower and a more focused pattern of energy as compared to an antenna without a reflector.

A radome 54 is illustrated in FIG. 3 and which serves to cover the antenna panel and backscreen. The radome is removed in FIGS. 2 and 3 for purposes of clarity. The radome may be constructed from fiberglass or dielectric insulating material and it serves to protect the antenna system from weather. The radome 54 encircles the peripheral lip 50 and is suitably secured thereto as with nuts and bolts.

A coaxial feed is provided for the antenna system and this feed includes a T-shaped power splitter having an input arm 60 and a pair of output arms 62 and 64. These arms are metal tubular elements and each serves as the outer conductor of a coaxial feed. Inner conductors 66, 68 and 70 are centrally located within arms 60, 62 and 64, respectively. The inner conductors 66, 68 and 70 may take the form of tubular members and each serves as the inner conductor of a coaxial feed. The inner conductors 66, 68 and 70 are all suitably connected together to form a T-shaped member inside the outer coaxial tubular members 60, 62 and 64.

Arm 60 extends through a rectangular plate 72 which is soldered to the arm and extends outwardly therefrom. The plate 72 is suitably secured, as by nuts and bolts, to the backscreen 10. An RF feed from an RF source 80 includes a semi-flexible coaxial cable having an outer conductor 82 and an inner conductor 84. In assembly, the outer conductor 82 is suitably connected to the outer conductor arm 60 whereas the inner conductor 84 is suitably connected to the inner conductor 66 of the power splitter.

The power splitter has a single coaxial input which includes the inner conductor 66 and the outer conductor 60. It also has a pair of coaxial outputs including the upper arm 62 which serves as an outer coaxial conductor and the inner conductor 68. Another coaxial output includes the lower arm 64 which serves as a coaxial outer conductor together with the inner conductor 70.

Each of the antennas 14 and 16 is provided with a pair of feed points 90 and 92 which are located on opposite sides of the slot 20 and intermediate the ends of the slot. These two feed points 90 and 92 for each antenna are connected to the coaxial feed system. The outer conductor is connected to feed point 90 and the inner conductor is connected to feed point 92. Specifically, the top of the outer conductor 62 is connected to the feed point 90 by means of a conductive saddle member 94. The saddle member 94 is electrically and mechanically connected to the feed point 90, as with a nut and bolt. Similarly, the upper end of the inner conductor 68 is electrically connected to the feed point 92 by means of a center conductor feed strap 96. Strap 96 is electrically connected to the inner conductor, but insulated from the outer conductor. The strap 96 extends across the slot 20 and is mechanically and electrically connected to the feed point 92, as with a pair of nuts and bolts. The bottom of the inner conductor is electrically and mechanically connected to the feed point 92 of the lower antenna 16 in the manner as discussed hereinabove with a feed strap 96. Also, the outer conductor or lower arm 64 is electrically and mechanically connected at its lower end to the feed point 90 with a saddle member 94.

From the foregoing, it is seen that the T-shaped power splitter serves as a coaxial feed having a single coaxial input having inner and outer conductors and a pair of coaxial outputs having inner and outer conductors. The inner and outer conductors of each of the coaxial outputs are connected across a respective one of the feed points of one of the antennas 14 and 16 so as to feed each pair of feed points with electromagnetic energy 180° out of phase.

The upper and lower arms 62 and 64 are mechanically and electrically connected to the intermediate member 18 by means of electrically conductive saddles 102 and 104. The saddles 102 and 104 may be connected to the intermediate member 18 at connection points 106 and 108, respectively, as with suitable nuts and bolts. The saddles 102 and 104 may be connected to coaxial conductor arms 62 and 64 by means of suitable electric straps 110 and 112, respectively.

Figure 6:
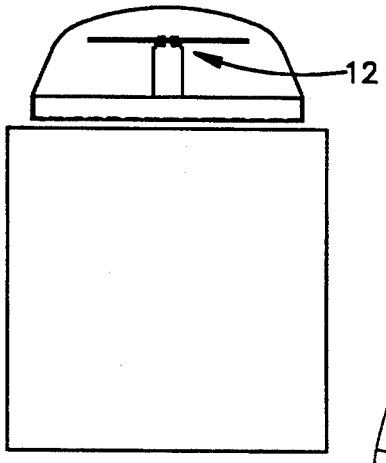
FIG. 6 is a schematic illustration of a plan view showing one manner in which an antenna panel in accordance with the invention may be mounted on one side of a vertically-extending tower.
Figure 7:
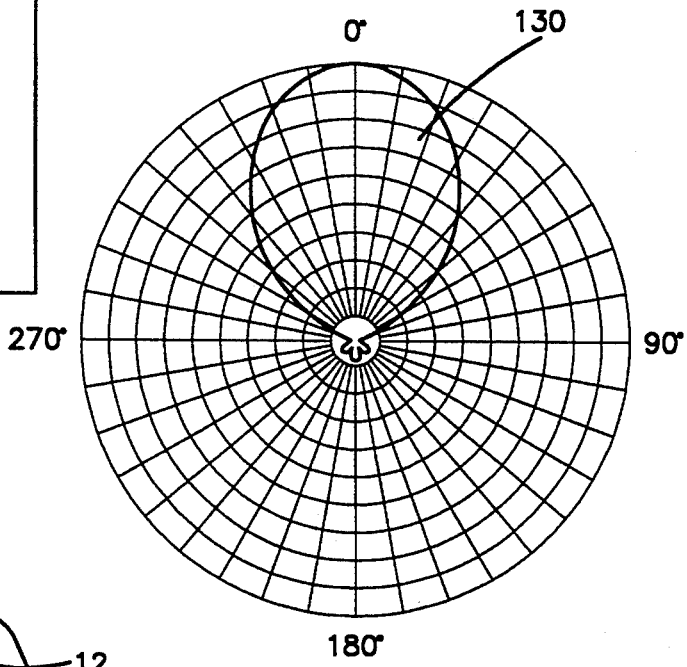
FIG. 7 illustrates a horizontal polarized azimuthal pattern for the embodiment of the invention shown in FIG. 6.

FIG. 6 is a schematic plan view looking down at a vertical tower having a radome covered antenna panel 12 constructed in accordance with FIGS. 1, 2 and 3. The relative field azimuthal pattern for the antenna system as shown in FIG. 6 is illustrated in FIG. 7 from which it is seen that the horizontally polarized pattern 130 radiated by the system is directed away from the face of the antenna tower to which the antenna panel is mounted. The antenna system of FIG. 8 exhibits an azimuth gain on the order of 5.38 (7.31 dB).

Figure 8:
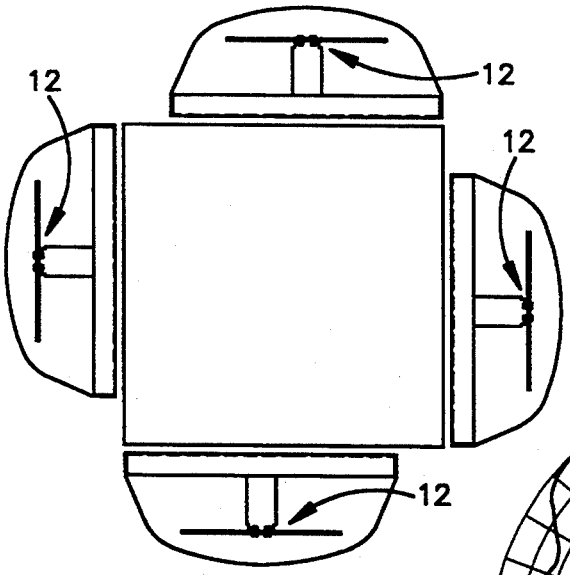
FIG. 8 is a plan view showing a second embodiment wherein an antenna panel and its reflector are mounted on each of four sides of a vertical tower.
Figure 9:
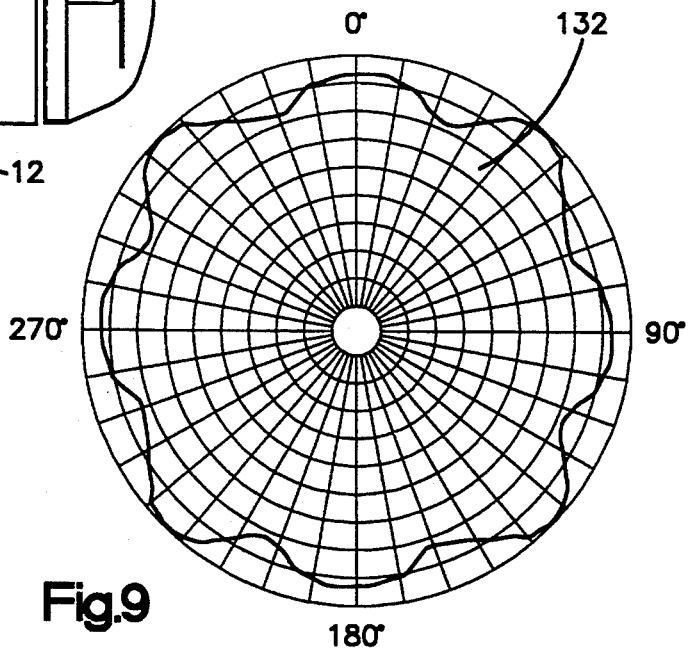
FIG. 9 illustrates a horizontal polarized azimuthal pattern for the embodiment of the invention of FIG. 8.

FIG. 8 is a view similar to that of FIG. 6 but illustrating four radome covered antenna systems, each constructed as described with reference to FIGS. 1–3. The four antenna systems are mounted on four different vertical faces of an antenna tower. The relative field azimuthal pattern 132 for the system as shown in FIG. 8 is illustrated in FIG. 9 from which it is seen that the horizontally polarized pattern 132 is omni-directional. The antenna systems of FIG. 8 exhibit an azimuth gain on the order of 1.21 (0.83 dB).

Although the invention has been described in conjunction with a preferred embodiment, it is to be appreciated that various modifications may be made without departing from the spirit and scope of the invention as defined by the appended claims.

Having described the invention, the following is claimed:

1. A slot fed antenna for use in radiating energy and comprising:

a flat conductive member having an elongated vertically-oriented slot dividing said member into a pair of horizontally-extending variable length flat dipole wing elements; and each of said flat dipole wing elements having a vertically-extending rectilinear edge formed by said slot, said edge having an upper end, a lower end, and a geometric center, each said wing element continuously and uniformly extending in width in a direction perpendicular to said edge from a minimum at the center of said edge and at each of the upper and lower ends of said edge to a maximum one-half way between each said end and said center and wherein the width at said upper end is equal to the width at said lower end and to the width at said center.

2. A slot fed antenna as set forth in claim 1 including means for applying RF energy across said slot at opposing locations along said rectilinear edges of said wing elements.

3. A slot fed antenna as set forth in claim 2 wherein said means for applying RF energy includes a pair of feed points respectively located on said wing elements near said rectilinear edges at locations essentially midway between said ends.

4. A slot fed antenna as set forth in claim 1 wherein each of said wing elements varies in width from a minimum of approximately 0.10 wavelength to a maximum of approximately 0.25 wavelength.

5. A slot fed antenna as set forth in claim 1 wherein the location of the maximum widths of each said wing element are vertically spaced apart by approximately 0.4 wavelength.

6. A slot fed antenna as set forth in claim 5 wherein each of said wing elements varies in width from a minimum width of approximately 0.1 wavelength to a maximum of approximately 0.25 wavelength.

7. A slot fed antenna as set forth in claim 1 having a pair of feed points respectively located on said wing elements on opposite sides of said slot with each said feed point being located intermediate said ends of said wing element.

8. A slot fed antenna as set forth in claim 7 wherein each said feed point is located near the center midway between the ends of said wing element.

9. A slot fed antenna as set forth in claim 7 including means for applying RF energy to said feed points for exciting said slot.

10. An antenna as set forth in claim 9 including a flat reflector spaced from said flat conductive member.

11. An antenna as set forth in claim 10 wherein said reflector is vertically oriented and has a peripheral edge which encircles an area greater than that of the peripheral edge of said conductive member.

12. An antenna as set forth in claim 11 including an elongated antenna panel containing a pair of said flat conductive members spaced vertically apart with each said member having a said elongated slot dividing said member into a pair of said slot fed horizontally-extending variable length flat dipole wing elements.

* * * * *